United States Patent [19]

Beller

[11] Patent Number: 4,848,316

[45] Date of Patent: Jul. 18, 1989

[54] TRAILER ADAPTER FOR COOKING DEVICES

[75] Inventor: Frank W. Beller, Aurora, Ill.

[73] Assignee: Belson Manufacturing Co., Inc., North Aurora, Ill.

[21] Appl. No.: 221,815

[22] Filed: Jul. 20, 1988

[51] Int. Cl.[4] ..... F24C 1/16

[52] U.S. Cl. ..... 126/276; 99/357; 99/339; 126/25 R; 126/268

[58] Field of Search ..... 126/25 R, 25 A, 25 AA, 126/9 R, 276, 268, 261; 296/22, 241; 99/402, 357, 397, 448; 108/44, 12, 18, 129, 131, 132

[56] References Cited

U.S. PATENT DOCUMENTS

| | | | |
|---|---|---|---|
| 3,696,803 | 10/1972 | Holloway, Jr. | 126/276 |
| 3,991,739 | 11/1976 | Hoffman, Jr. | 126/276 |
| 4,364,310 | 12/1982 | Rufkahr | 126/276 |
| 4,690,125 | 9/1987 | Beller | 126/25 R |
| 4,757,755 | 7/1988 | Sarten | 126/276 |

*Primary Examiner*—James C. Yeung
*Attorney, Agent, or Firm*—Lee & Smith

[57] ABSTRACT

A trailer and a trailer adapter for removably supporting a grill of the type having a generally rectangular firebox with opposing longer walls, transverse shorter walls, and a bed extending to form a bottom of the firebox. The trailer adapter has four connected panels also having a generally rectangular configuration with two opposing longer panels and transversely opposing shorter panels. The opposing longer panels and one shorter panel removably support the grill. The trailer has frame members supportively extending below the four panels of the trailer adapter. Mechanical fasteners releasably fasten the trailer adapter panels to the trailer frame so that the adapter may also be disengaged from the trailer.

17 Claims, 2 Drawing Sheets

62
61
64
62
64
63
52
48
50
46
45
57
51
55
47
66
54
12
10
69
32
41
58
38
68
65
58
30
65
27
33
69
36
40
68
34
29
35
37
31
11
39
13
14
13
19
13
31
20
24

47
51
46
41
66
54
45
56
29
68
27
40
35
38
13
39

61
65
53
64
45
47
55
P
54
L
56
43
29
38
42
28
35
13
39

61
48
50
41
45
65
64
54
69
56
27
30
68
38
40
34
13
14
39
19

61
63
53
47
65
43a
45
64
10a
49
57
55
58a
69a
54
56
68a
29
28a
38
35
40a
39
13

TRAILER ADAPTER FOR COOKING DEVICES

BACKGROUND OF THE INVENTION

The invention generally relates to an adapter for a vehicle-towed trailer capable of use with a variety of cooking devices to render them mobile. In more particular detail the invention is related to portable or mobile outdoor cooking grills including an adapter releasably mounted on the frame of a trailer for accommodation of different type grills or roasting devices.

Mobile outdoor cooking devices that are offered in combination with trailers are known in the industry and allow the commercial caterer, restaurant service, or the like, to travel to remote locations and provide food service for large numbers of people, such as at picnics, carnivals and other social activities. Some outdoor cooking grills and ovens are mounted on their own legs and wheels and may be wheeled about, for example, on a patio or clubhouse veranda. With certain cooking devices the legs and wheels may be removed for storage or transport. Cooking devices utilizing hitched trailers have heretofore been formed as part of the trailer and have not been able to be removed from the trailer frame for separate, or independent use.

It would be a great advantage to those that provide outdoor cooking services to have available to cooking grill or oven device that may be used on its own legs in the first instance, and secondly, also be capable of being easily mounted on a mobile trailer unit. It would therefore accordingly be desirable to provide a transport vehicle that includes a trailer adapter that may be removable from the trailer frame so that the trailer may be used to transport other things, but primarily used for attachment of the trailer adapter. The trailer adapter would be also desirably formed to accommodate a plurality of grills whereby to render them all mobile upon the removal of any support legs and positioning onto the trailer adapter.

It would be desirable to provide a trailer adapter that releasably fastens to the frame of a vehicle-drawn trailer whereby the trailer may have other uses so that it is not limited to use as a cooking device. In this way, the cooking devices also might be separately used as stand-alone units on their own support legs.

It would also be a great advantage to the cooking industry in providing a transport vehicle for grills having standard removable legs whereby the legs might be removed and the grill conveyed to a remote location whereupon the grill may be taken from the trailer adapter and remounted with the legs. In this regard the trailer is simply used as a conveyance device and is not required to be present for cooking at the remote location, but may be taken elsewhere for other purposes.

In brief summary, the invention may be described as a trailer adapter, preferentially having a rectangular configuration in plan with two opposing long panels and two opposing shorter panels. The trailer adapter panels are desirably welded together for unitary construction, wherein a first shorter panel is arranged to be disposed generally adjacent the hitch assembly end of the trailer and joined to front ends of the long panels. In one form of the invention an opposing second shorter panel has a height less than the first shorter panel and is welded to the opposite, or rear, ends of the long panels; and in an alternate form the second shorter panel has the same height as the first shorter panel.

The trailer adapter includes inward flanges at the lower ends of the panels for resting atop the typical box-beam frame members of a trailer and having bolt-receiving holes facilitating removable attachment to the frame. The upper edges of the long panels and upper edges of said first shorter panel adjacent the hitch assembly are provided in the first form of the invention with outward flanged portions for supportively nesting underneath the complementarily shaped flanged lips of the firebox walls of a gas grill device having gas control panel means at one end. Thereby the adapter is flange-nested along the two opposing long panels and one shorter panel. The opposing second shorter wall includes a flange for supporting the bed of the firebox therealong. In the second form, the second shorter panel of the trailer adapter is the same height as the first shorter panel and also includes an outward flange for nesting underneath the flanged lip of the fourth wall of a grill firebox.

The firebox of the supported grill is arranged to be disposed generally with a major portion within the four panels of the trailer adapter. The first shorter panel of the adapter is desirably provided with engageable apertures for the receipt therethrough of bolts whereby to be capable of receiving bolts that may extend through a corresponding end wall of a firebox and through a grill support panel mounted to said firebox wall, for releasably securing the grill to the adapter.

The trailer adapter is preferably provided with L-shaped angle bracket connectors weld-engaged to the ends of the long panels and to the first shorter panel whereby the first shorter panel is spaced lengthwise and forward of the long panels to form spaces, or slots, in order to accommodate flanged portions of the end walls of grill fireboxes within the slots. Slots may also be similarly created by means of bracket connectors at the second shorter wall for the second form having a height substantially the same as the first shorter wall for use particularly with charcoal grills where the front and rear end walls are the same and no gas control panel is attached at either end wall.

The trailer adapter may be readily removable from the trailer by use of simple nut and bolt fasteners, whereby to allow the trailer to be quickly converted for other purposes.

For additional anti-rattle and anti-vibration construction to withstand over-the-road-transport, bolts or self-tapping screws may be engaged through the flanged lips of the firebox walls and the upper flanges of the adapter panels.

DETAILED DESCRIPTION OF THE INVENTION

Figure 1:
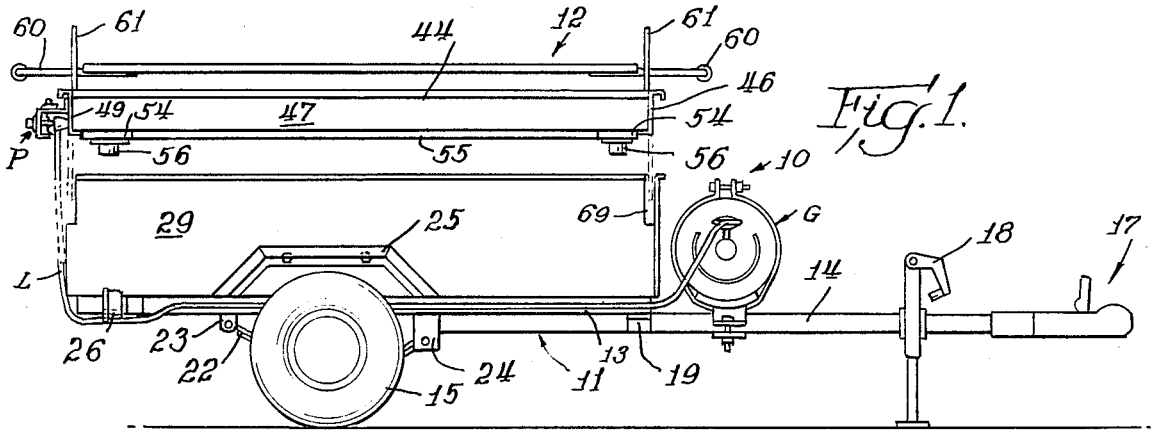
FIG. 1 is a side view of a trailer having the trailer adapter releasably mounted thereto in accord with the invention and further showing a portable gas grill is an exploded illustration to be spaced above ready to be mounted onto the trailer adapter.

With reference to the drawings, like reference numerals refer to the same elements throughout.

In order to most simply introduce the invention as shown in the preferred embodiment found in the drawings, it would serve to initially state that the invention involves the provision of a unique trailer adapter 10 for use with a trailer 11 and a grill 12 whereby the trailer adapter 10 may be removed from the trailer 11 so that the trailer can be used for other purposes. The trailer adapter 10 is shown for use with a particular gas grill denoted at reference number 12, but other varieties of grills may similarly be mounted to the adapter 10 to make them portable. The gas grill 12 is of a well known type and is illustrated with standard removable legs (not shown) taken off and is ready for mounting to the adapter 10. The grill 12 has a gas control panel P and gas line connected to a supply of bottled gas G.

Figure 2:
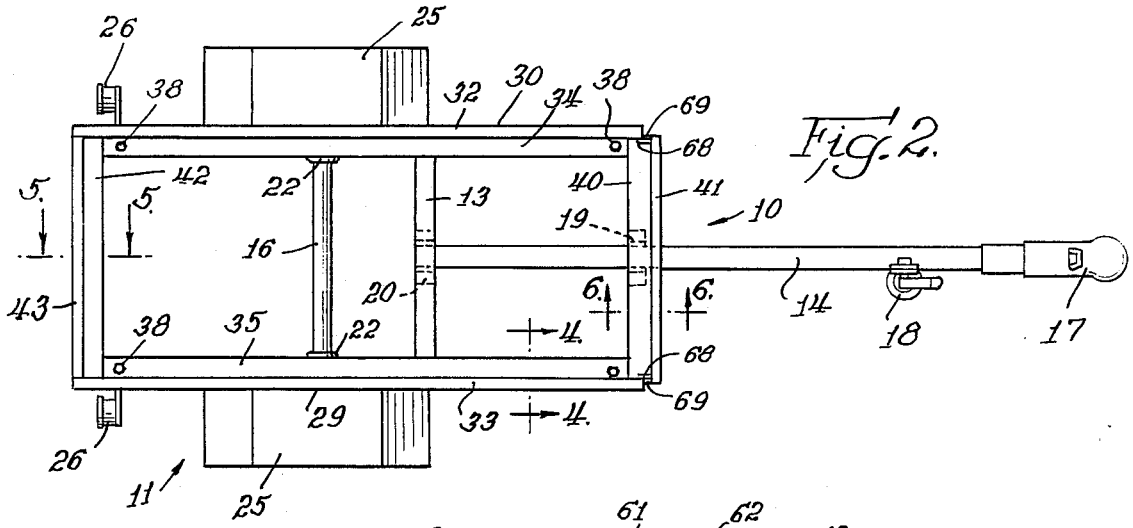
FIG. 2 is a top view of the trailer and trailer adapter as shown in FIG. 1 with the grill removed.
Figure 3:
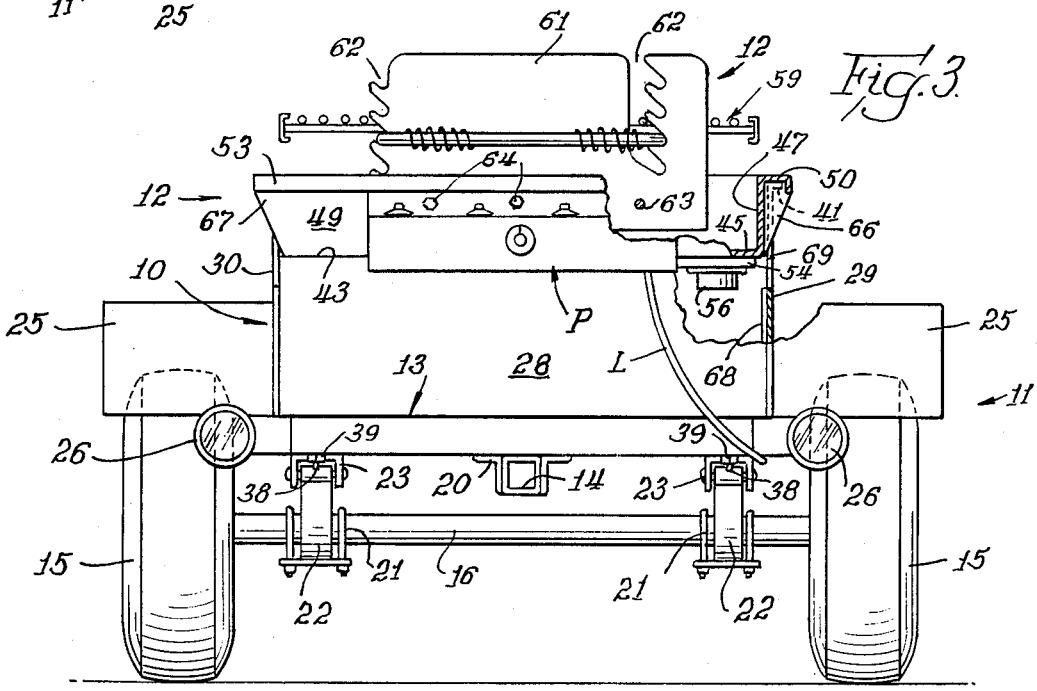
FIG. 3 is a rear elevational view of the trailer, trailer adapter and grill as shown in FIGS. 1 and 2, partially broken away to show the interior of the grill firebox and trailer adapter and wherein the grill is mountably supported atop said trailer adapter.

With detailed reference made to FIGS. 1–3, the detailed description of the trailer 11 will be first undertaken. The trailer 11 is of a relatively standard construction wherein an understructure frame 13 is made up of a plurality of tubular frame members 13, preferably 2 inch square steel tubing, joined to form a rectangular configuration in plan and having four corners in a conventional arrangement. A forward extending tongue 14 is provided to extend to the towing vehicle. Standard tires 15 support the trailer 11 and are mounted on an axle 16. At the forward end of the tongue 14, a hitch assembly 17 is provided for attachment to the towing vehicle; and, when not attached, a tongue jack assembly 18 is provided to support the trailer 11 as shown in FIG. 1.

Brackets 19 and 20 support the tongue 14 to, and underneath, the frame members 13. Axle brackets 21 supportively engage the axle 16 and are resiliently supported by leaf springs 22 to the understructure frame members 13 as best viewed in FIG. 3. Thereby, the trailer 11 is provided for towing along a highway and for off-the-road applications. The leaf springs are endwise attached to the understructure frame members 13 by rear spring brackets 23 at one end, and front spring brackets 24 at the other, as shown in FIGS. 1 and 3. Fenders 25 are bolted to the adapter 10 to cover over the tires 15. Tail lights 26 are provided to the rear of the frame members 13 in a conventional manner. The structure and design of the trailer 11 is suited for alternate use with, for example, flat beds that might be attached to the understructure frame members 13, or cargo boxes and the like, so that the trailer 11 may have many other uses. In the disclosed embodiment, the trailer 11 is removably mounted by the inventive trailer adapter 10 which makes it possible for grills, rotisserie ovens, etc., to be mobile and transportable to remote locations.

Figure 8:
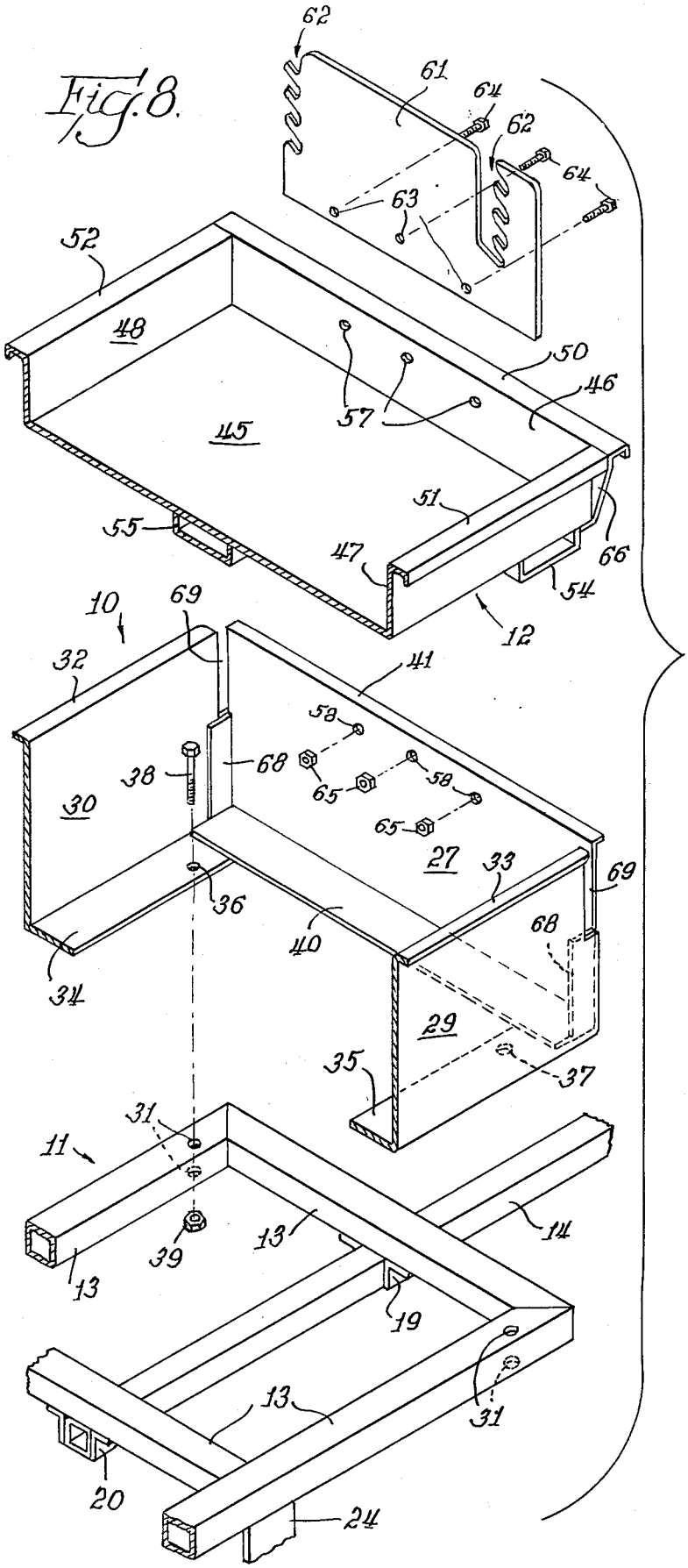
FIG. 8 is an exploded perspective view of front portions of the grill, adapter and trailer as shown in FIG. 1, including a grill support panel attached to the firebox, and depicting the understructure for the trailer frame having apertures for bolting the adapter to the trailer frame.
Figure 4:
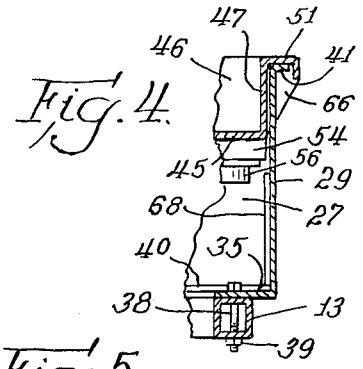
FIG. 4 is a typical sectional view of one of the long sides of the trailer adapter and grill taken along line 4—4 of FIG. 2.

Turning now to the trailer adapter 10, it will be noted with respect to the Figures that the adapter 10 is formed from a plurality of panels that set upon the trailer 11 as shown in FIGS. 1–3 and 8. The trailer adapter 10 panels comprise a frontward end panel 27 opposing a rearward end panel 28 joined therebetween by parallel and longer side panels 29 and 30. The panels 27–30 are welded together in an arrangement as will be hereinafter explained in detail whereby to provide a frame-like construction for the trailer adapter 10 that is movable as a unit enabling its placement and securement onto the trailer 11 by mechanical fastening at frame apertures 31 as shown in FIG. 8.

The specific configurations for the unique trailer adapter 10 and the panel members 27–30 will now be explained. The long side panel 30, which in the preferred embodiment would face the chef during cooking, is provided with an outward extending top flange 32 best shown in FIG. 8. Similarly, the opposite side panel 29 includes an outward extending top flange 33. Extending inwardly of the adapter 10, the side panel 30 further includes a bottom flange 34 which is wider than the top flange 32 and is provided a set atop a respective long frame member 13 therebelow. Likewise, the side panel 29 is provided with an opposingly directed bottom flange 35 that is wider than the top flange 33 and similarly designed to set atop the long frame member 13 therebelow. The flange 34 is provided with a pair of bolt holes 36 one of which is shown in FIG. 8 for alignment over the bolt receiving apertures 31 of the frame members 13. On the other side of the adapter 10, the flange 35 is provided with a pair of bolt holes 37 also aligning with the corresponding bolt receiving apertures 31 of the frame 13. With reference to FIG. 2 and FIG. 8, bolts 38 are secured by conventional nuts 39 and extend through the bolt holes 36 and 37 for securement of the side panels 30 and 29, respectively, and thereby attach the adapter 10 to the frame members 13. Four bolts 38 and nuts 39 are thus provided in the exemplary embodiment, whereby the adapter 10 is easily but securely releaseably fastened to the trailer 11 at these four mechanical fastenings and also at the bolt fastening to the fenders 25 (not shown).

Figure 5:
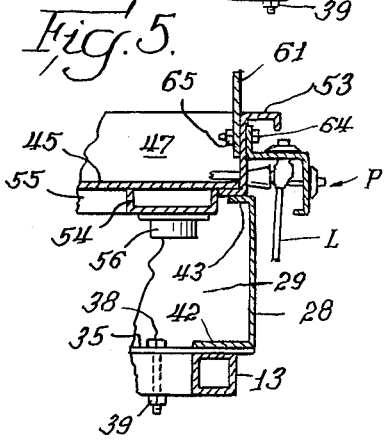
FIG. 5 is a typical sectional view of the rear end of the trailer adapter and grill taken along line 5—5 of FIG. 2.
Figure 6:
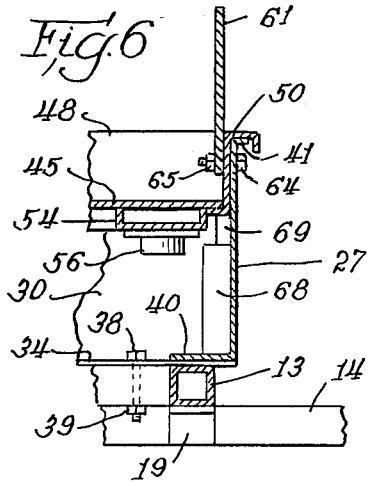
FIG. 6 is a typical sectional view of the front end taken along line 6—6 of FIG. 2 and showing the grill mounted to the adapter by means of nut and bolt fasteners binding a grill support panel, front wall of the grill firebox and the adapter together.

With reference now made to FIGS. 5 and 6, the frontward end panel 27 and rearward end panel 28 will be seen to be seated upon transverse shorter frame members 13 and do not include bolt receiving apertures. At the frontward end panel 27, an inwardly extending bottom flange 40 is formed to extend atop end portions of the wider flanges 34 and 35 of the side panels 30 and 29, respectively. From the upper edge of the panel 27, a top flange 41 extends outwardly thereof. Similarly, the rearward end panel 28 is provided with a bottom flange 42 that extends inwardly and overlaps end portions of the flanges 34 and 35 as seen in FIG. 2. It will therefore be understood that the bolts 38 and nuts 39 fasten the adapter 10 in place, with the bottom flanges 34, 35, 40 and 42 seated atop the frame members 13.

The outward extending flanges 32, 33, 41 and inward extending flange 43 of the panels 30, 29, 27 and 28, respectively, provide support for the grill device 12 at its firebox 44. The firebox 44 has a known grill construction design wherein a rectangular bed 45 extends underneath gas burners (not shown) mounted in firebox 44. Surrounding walls are joined to the bed 45 and form the box-shape of the firebox 44, namely a front wall 46, opposing longer side walls 47, 48 and rear wall 49. The gas control panel P for the gas burners is mounted on the outside of the rear wall 49.

The firebox walls 46–49 are provided with upper generally outward extending L-shaped flanges or lips that are substantially identical in section. The front wall 46 is provided with an outwardly extending L-shaped flange 50. Side walls 47 and 48, respectively, are provided with L-shaped outwardly extending flanges 51 and 52. The rear wall 48 of the firebox is formed with an L-shaped flange 53. The flanges 50-52 are complementarily shaped for nested engagement over the top flanges 41, 33, 32, respectively. Although identically shaped, the flange 53 does not nest-engage with the adapter 10 and the rear end of the firebox 44 is otherwise supported at the flange 43, as will be hereinafter explained. The flanges 32, 33 and 41 are shaped to fit underneath and support the L-shaped flanges of the firebox 44 so that the flange 50 rests atop the flange 41, the flange 51 rests atop the flange 33, and flange 52 rests atop the flange 32, all in overlapping nested-type arrangement. As noted, a different relationship is provided between the flange 43 of the rear panel 28 and the firebox 44 in order to accommodate the gas control panel P extending outwardly from the grill 12 to facilitate manual operation. As best observed in the cross-sectional view of FIG. 5, it will be seen that the flange 43 is inwardly directed with respect to the trailer adapter 10 and provides support for the firebox 44, under the bed 45, generally along and below the rear wall 49. This arrangement at the flange 43 is different from the other three walls, since along the rear of the firebox 44 it is the bottom of the bed 45 that is supported instead of the wall flange 53 of the rear wall 48. The support arrangement below the rear wall 48 allows the gas grill 12 to be used with the trailer adapter 10 so that burner control knobs and the like at panel P may extend outwardly from the firebox 44 over the rear panel 28 in order to be fully accessible for control of the gas burner heating source. A second form of the invention will be discussed hereinafter with respect to a rear panel 28a having a height the same as the other panels for supporting a firebox wall flange like the other three panels.

Comprising a typical design for the firebox of a grill, the firebox 44 is made of sturdy and heat resistant sheet steel. For rigidification and reinforcement, both transverse and lengthwise reinforcement channels are provided to be welded underneath the bed 45. A plurality of transverse reinforcement channels 54 extend for substantially the full width of the bed 45 and a central lengthwise reinforcement channel 55 extends generally for the full distance between the front wall 46 and rear wall 48 as shown in FIG. 1.

It is envisioned that the trailer adapter 10 is well suited for use with grills having removable legs so that a grill might be used in one location, such as the patio of a clubhouse, and then with legs removed, transported on the trailer adapter 10 and the trailer 11 to a remote picnic site, or the like, when needed. Thereby, a single grill could be used in remote settings to offer a very efficient and economically advantageous cooking system.

In the exemplary embodiment, the grill 12 is provided with four standard leg collar connectors 56 which are engageable by conventional legs (not shown). In the drawings, the grill 12 is depicted with its legs having been removed whereby the grill 12 is mountably engageable to the trailer adapter 10. The leg collar connectors 56 of the illustrative embodiment are fixed to the reinforcement channels 54 and are located inwardly of the firebox side walls a sufficient distance whereby to easily fit within the trailer adapter 10 by being spaced from the walls 27–30.

The engagement of the grill 12 to the trailer adapter 10 will now be explained in greater detail. Also, it will be seen that the grill 12 includes adjustable grill panels and supports which are also cooperative with the adapter 10 for mounted engagement thereto. With reference now made to FIGS. 3 and 8, it will be observed that the front wall 46 and the rear wall 48 of the firebox 44 are provided with opposing sets of holes 57. At least the set at the front wall 46 corresponds to a like set of holes 58 through the front panel 27 of the trailer adapter 10. The purpose of the holes 57 and 58 will be clear by a description of the construction of the grill 12. The grill 12 is provided with a typical grill member 59 upon which food items may be placed and having crossing nickel-chrome plated grill rods in a conventional arrangement, which forms no part of the present invention. The grill member 59 thus has a framework-like structure and includes outwardly extending handles 60 as shown in FIG. 1. The handles 60 are selectively and adjustably supported at two grill support panels 61, which are located at both ends of the grill 12. The grill support panels 61 each include two sets of handle support slots 62 for the selective arrangement of the handles 60 whereby the grill member 59 is adjustable relative to the firebox 44. As best shown in FIG. 8, the grill support panel 61 at the front of the grill 12 may be attached to the firebox 44 at a like plurality of holes 63 corresponding to the holes 57 of the firebox wall 46. Bolts 64 extend through the holes 63 and through holes 57 to be secured inside of the firebox by thread engageable nut fasteners 65. The attachment of the opposite rear grill support panel 61 can be similarly made to the firebox rear wall 49, as shown in section in FIG. 5. The grill support panels 61 are therefore identically engaged at the opposite walls 46 and 49 of the firebox 44. The grill support panels 61 are removably attachable to the firebox 44 so that the grill 12 may be converted, for example, to a rotisserie oven-type grill after the grill member 59 and grill support panels 61 are removed.

The invention takes advantage of the grill support panel attachment arrangement by the provision of a set of corresponding holes 58 extending through the front panel 27 whereby the grill firebox 44 and grill support panel 61 may be removably attached to the front panel 27 by means of bolts 65 and nuts 65, as also clearly viewed in FIG. 5. Thereby, the grill 12 is releasably secured to the trailer adapter 10 which holds the grill in place during transport over the road. Additional attachment may also be made by means of bolts or self-tapping screws (not shown) extending through the nested flanges 51 on 33 and 52 on 32, of the firebox sidewalls and adapted side panels, respectively. This optional extra attachment aids in controlling over-the-road vibration and rattle.

Considering the standard configuration for the firebox 44 that has the top outward extending flanges 50–53, it will be seen that beveled flanges 66 are provided to taper the dimension of the front wall 46 from the flange 50 downwardly to the bed 45 in a smooth angled transition which avoids creating sharp edges. This transition forms the triangular formation of the flanges 66 which project transversely of the side wall 47 as shown in FIG. 8. Similarly, the rear wall 28 includes beveled flanges 67 extending downward from the flange 53, as shown in FIG. 3.

The firebox side walls 47 and 48 are weld engaged at the four corners of the firebox to the front and rear walls 46 and 48, respectively and create a smooth planar surface relationship among the flanges 50–53 following around the upper periphery of the firebox 44.

In order for the adapter 10 to accommodate the beveled flanges 66, the front panel 27 is forwardly spaced from the side panels 29 and 30 by means of corner angle brackets 68, which extend partway up the height of the trailer adapter 10, as shown in FIG. 1 and 8. This spacing is made to create slots 69 therebetween for the sliding insertion of the flanges 66 when the grill 12 is rested atop the trailer adapter 10. The slots 69 are sufficiently wide to provide clearance for the width of the flanges 66 therethrough. The depth of the slots 69 is no less than the height of the front wall 46 in order to accommodate the height of the flanges 66.

In another regard, the accommodation of the flanges 66 in the slots 69 helps to further secure the grill 12. The flanges 66 prevent lengthwise sliding translation of the firebox 44 regardless of whether the firebox is bolt-secured to the front wall 27, since the flanges 66 securely seat in the slots 69 between the front wall 27 and ends of the side walls 47 and 48.

As would be clear to one skilled in the art, the trailer adapter 10 likewise may be alternately made to have the front end panel, not the rear panel 28, formed to be the one with the reduced height for disposition of the gas control panel end of the grill 12 thereat in a 180° reversed orientation. Other equivalent variations and modifications of the invention will also be apparent.

Figure 7:
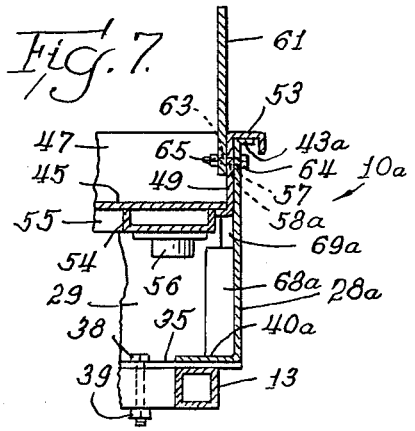
FIG. 7 is a typical sectional view taken through the rear shorter panel of the adapter in the second form of the invention for use with a charcoal burning grill, or the like, that does not include a gas control panel means, wherein the rear panel of the adapter is the same height as the front panel and wherein they connect in the same way to the longer side panels.

In a second form of the invention, a trailer adapter **10*a* may have four panels of equal height, as shown in FIG. 7, wherein the rear panel denoted at 28*a* is full height as compared with pane 28 shown in FIG. 5. An upper flange 43*a* thereof is the reverse of flange 43, whereby to be outwardly formed, the same as flanges 32, 33 and 41. Thereby, a charcoal, mesquite, wood burning grill, or the like, having no gas control panel, may be supported at the flange of a rear firebox wall the same as at the front wall 27. Accordingly, it will be seen that in FIG. 7 the firebox is the same as in FIG. 5, but without the panel P, so that the outward flange 53 nest engages atop the flange 43*a*. The firebox 44 of the grill 10, absent a panel P, will be understood to be reverse positionable on the adapter 10a with the upper flanges 50 or 53 of the wall 46 or wall 49 each capable of being engageably nested on the flange 43*a* of the panel 28*a***.

Since panel **28*a* extends upward to a full height, substantially higher than in the first form of the invention at panel 28, there is a like need to create slots to accommodate the tapering flanges 67 in the same manner as flanges 66 are shown to be accommodated in FIG. 8. Similarly, angle brackets 68*a* are welded to the rear wall 28*a* to space it lengthwise of the rear ends of the side panels, comparable to the arrangement in FIG. 8 at front panel 27, and create slots 69*a*** therebetween.

The rear panel **28*a* includes a lower inward flange 40*a* to be supported atop a frame member 13 of the trailer 11 and also provides a set of holes 58*a* for the attachment of bolts 64 and nuts 65 to the firebox end wall 49 and support panel 61, the same as the firebox and support panel attachment at front panel 27, as would be clear. The extra bolt or self tapping screw fasteners along the side wall flanges 51 and 52 therefore may not be needed because both support panels 61 can be secured to the trailer adapter in this form of the invention. Other than the increased height and reversal of the projecting upper flange at 43*a*, the trailer adapter 10*a* of the second form of the invention is identical to the trailer adapter 10** of the first form.

It will therefore be clear that the inventive trailer adapter 10, 10a may be selectively used in conjunction with a trailer 11 or disengaged to permit separate use of the trailer. The trailer adapter 10, **10*a* is provided to accommodate a wide variety of grills having a firebox with flange-like, or equivalent, means along the walls of the firebox as explained in reference to the described grill 12. A grill 12 or equivalent, may be mounted to the trailer adapter 10, 10*a***, or otherwise removed from it and have its legs reconnected for use in a standard manner.

While the foregoing description is intended to explain the invention, it is to be understood that the description and drawings are provided in reference to preferred embodiments of the invention, but the invention is not limited thereto as claimed in the appended claims. Accordingly a wide range of equivelants fall within the scope of the invention.

What is claimed is:

1. In combination, a grill device, a trailer adapter and a trailer:

said grill device including a generally rectangular firebox having opposing longer walls and transverse opposing shorter walls, said walls including outwardly extending flanges and wherein said firebox includes a bed extending to form a bottom of the firebox and being connected to said walls; said trailer adapter including four connected panels having a generally rectangular configuration with two opposing longer panels and transversely opposing shorter panels, said opposing longer panels and at least one of said shorter panels including flange means extending therefrom and being capable of being arranged for nested engagement with the flanges of the opposing longer walls of said grill and the flange of one of said transversely opposing shorter walls, respectively, and wherein said opposing shorter panels of the trailer adapter being opposed at a distance substantially the same as the opposing shorter walls of the firebox of the grill device; and, said trailer comprising frame means having frame members arranged to extend generally underneath the four panels of said trailer adapter, means for releasably fastening the trailer adapter panels thereto, a vehicle-engageable hitch assembly for attaching the trailer to a vehicle, and further including wheel and suspension means attached to the frame means for rolling the trailer;

wherein said grill, trailer adapter and trailer are separable from each.

2. The combination as in claim 1 wherein said at least one opposing shorter panel including the flange means is spaced from said two longer panels by spacing means, said spacing means extending partway of the height of said trailer adapter whereby to create slot means between the said at least one opposing shorter panel and said two longer panels.

3. The combination as claimed in claim 1 wherein the height of said trailer adapter is greater than the depth of said firebox, whereby said firebox may be sustantially accommodated therein with clearance between the trailer frame means and bed of said firebox.

4. The combination as in claim 2 wherein said grill and trailer adapter are releasably engaged together by mechanical fastening means therebetween.

5. The combination as claimed in claim 1 wherein the panels of said trailer adapter are weld connected forming a rigid unitary construction for releasable attachment to said trailer.

6. The combination as claimed in claim 1 wherein said front panel of said trailer adapter includes a set of holes therethrough.

7. The combination as claimed in claim 6 wherein said grill includes a grill member and a grill support panel means, said grill support panel means being releasably attached to the front and rear walls of said firebox by releasable fastening means, said releasable fastening means being engageable through said set of holes of the front panel of said trailer adapter.

8. The combination as claimed in claim 1 wherein one said shorter panel opposing the one having said flange means has a height less than the height of the longer side panels, the bed of the firebox supportively resting thereon and the flanges of the longer walls and one shorter wall of the firebox respectively net engaged on the flanges of said longer panels and said at least one shorter panel of the trailer adapter.

9. The combination as claimed in claim 1 wherein the four panels of the trailer adapter have bottom flange means, said releasable fastening means releasably fastening said bottom flange means to said trailer frame members.

10. In combination, a trailer, a trailer adapter therefor for mounting thereon a cooking grill device and a cooking grill device, said trailer and trailer adapter comprising:

a trailer having a frame, a tongue member extending frontwardly of the frame, said frame being mounted on suspension and tire means for the transport thereof and wherein said tongue includes a hitch assembly for attachment to a towing vehicle, said frame including at least four frame members joined to form four frame corners and including means for engaging mechanical fasteners therealong;

said trailer adapter comprising four panels having two opposing long panels and two transversely opposing shorter panels, said opposing shorter panels being a first panel having a first height and a second panel having a second height less than the first, said panels having bottom flange means, said bottom flange means including means for engagement of mechanical fasteners thereto positionally corresponding to the means for engaging mechanical fasteners of said trailer frame, said two longer panels and said first shorter panel extending upwardly from said trailer frame to substantially the same height, said two longer panels and said first shorter panel having upper flange means extending therefrom for supportive engagement with flange means of a grill firebox, said second shorter panel terminating in an upper flange means for supporting a bed of said grill firebox thereon, and said first shorter panel including means for engaging mechanical fasteners for attachment to a grill.

11. The trailer adapter as claimed in claim 10 wherein said trailer adapter long panels are spaced from said first shorter panel by spacing means engaged therebetween.

12. The trailer adapter and trailer as claimed in claim 10 wherein said spacing means extend upwardly for less than the full height of said long panels and said first shorter panel whereby to define slots between the long panels and first shorter panel.

13. The trailer adapter and trailer as claimed in claim 12 wherein said spacing means comprises at least one metal angle bracket.

14. In combination, a trailer, a trailer adapter therefor for mounting thereon a cooking grill device and a cooking grill device, said trailer and trailer adapter comprising:

a trailer having a frame, a tongue member extending frontwardly of the frame, said frame being mounted on suspension and tire means for the transport thereof and wherein said tongue includes a hitch assembly for attachment to a towing vehicle, said frame including at least four frame members joined to form four frame corners and including means for engaging mechanical fasteners therealong;

said trailer adapter comprising four panels having two opposing long panels and two transversely opposing shorter panels, said opposing shorter panels being fixedly attached to said long panels whereby to be movable together as a unit, said panels having substantially the same height and including bottom flange means having means for engagement of mechanical fasteners thereto positionally corresponding to the means for engaging mechanical fasteners of said trailer frame, said panels having upper flange means extending therefrom for supportive engagement with flange means of a grill firebox and at least one of said shorter panels including means for engaging mechanical fasteners for attachment to a grill.

15. The trailer and trailer adapter as claimed in claim 14 wherein said trailer adapter long panels are spaced from said first shorter panel by spacing means engaged therebetween.

16. The trailer adapter and trailer as claimed in claim 14 wherein said spacing means extend upwardly for less than the full height of said long panels and said first shorter panel whereby to define slots between the long panels and first shorter panel.

17. The trailer adapter and trailer as claimed in claim 16 wherein said spacing means comprises at least one metal angle bracket.

* * * * *